US008032045B2

(12) United States Patent
Chae et al.

(10) Patent No.: US 8,032,045 B2
(45) Date of Patent: Oct. 4, 2011

(54) FUSING DEVICE HEATED BY INDUCED CURRENT FOR INSTANTLY CONTROLLING POWER

(75) Inventors: Young-min Chae, Suwon-si (KR); Sang-yong Han, Suwon-si (KR); Hwan-guem Kim, Seoul (KR); Durk-hyun Cho, Suwon-si (KR); Su-Kyoung Chae, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 555 days.

(21) Appl. No.: 11/302,362

(22) Filed: Dec. 14, 2005

(65) Prior Publication Data

US 2007/0009274 A1 Jan. 11, 2007

(30) Foreign Application Priority Data

Dec. 14, 2004 (KR) ..... 10-2004-0105617

(51) Int. Cl.
*G03G 15/20* (2006.01)

(52) U.S. Cl. ..... 399/69; 219/216

(58) Field of Classification Search ..... 399/69; 219/216

See application file for complete search history.

(56) References Cited

U.S. PATENT DOCUMENTS

| | | | | |
|---|---|---|---|---|
| 5,789,723 | A * | 8/1998 | Hirst | 219/216 |
| 6,069,346 | A * | 5/2000 | Hyllberg | 219/469 |
| 6,317,571 | B1 * | 11/2001 | Adams | 399/67 |
| 2005/0286926 | A1 * | 12/2005 | Chae et al. | 399/88 |

FOREIGN PATENT DOCUMENTS

| | | | |
|---|---|---|---|
| JP | 08-234621 | | 9/1996 |
| JP | 2000-245161 | | 9/2000 |
| JP | 2000-259018 | | 9/2000 |
| JP | 2002-124369 | | 4/2002 |
| JP | 2002-174973 | | 6/2002 |
| JP | 2002-237377 | | 8/2002 |
| JP | 2004-004205 | | 1/2004 |
| KR | 10-2002-0063663 | A | 8/2002 |
| KR | 1020040010864 | A | 2/2004 |

* cited by examiner

*Primary Examiner* — David M Gray
*Assistant Examiner* — Ruth N Labombard
(74) *Attorney, Agent, or Firm* — Roylance, Abrams, Berdo & Goodman L.L.P.

(57) ABSTRACT

A device for fusing and fixing a transferred toner of a predetermined image onto a print paper is provided. In particular, a fusing device which can instantly control induced current provided to a fusing unit in an image printing apparatus which heats the fusing unit using the induced current is provided. The fusing device includes a fusing unit which is resistance heated or induction heated by an induced current, and fuses the toner onto the print paper using the generated heat. A sensing unit senses the temperature of the fusing unit. A reference current generating unit generates a predetermined reference current to heat the fusing unit to reach a predetermined temperature based on the temperature of the sensed fusing unit and the reference temperature. A pulse width modulation signal generating unit generates a pulse width modulation signal for generating the induced current so that the induced current corresponding to the reference current is supplied to the fusing unit.

14 Claims, 9 Drawing Sheets
(3 of 9 Drawing Sheet(s) Filed in Color)

FUSING DEVICE HEATED BY INDUCED CURRENT FOR INSTANTLY CONTROLLING POWER

BACKGROUND OF THE INVENTION

This application claims the benefit under 35 U.S.C. §119 (a) of Korean Patent Application No. 10-2004-0105617, filed on Dec. 14, 2004 in the Korean Intellectual Property Office, the entire disclosure of which is hereby incorporated by reference.

FIELD OF THE INVENTION

The present invention relates to a device for fusing and fixing a transferred toner of a predetermined image onto a print paper. More particularly, the present invention relates to a fusing device which can instantly control induced current supplied to a fusing unit in an image printing apparatus which heats the fusing unit using the induced current.

DESCRIPTION OF THE RELATED ART

A conventional image printing apparatus includes a fusing device which applies predetermined pressure and heat to a print toner to fuse and fix a transferred toner of a predetermined image onto a print paper. The fusing device includes a fusing unit to apply a predetermined heat to the print toner, and a pressure unit to apply a predetermined pressure to the print toner. The fusing unit includes a heating element which generates heat to fuse and fix the toner onto the print paper, and a fusing roller which receives the heat produced by the heating element and transfers the heat to the print paper.

FIG. 1 is a schematic horizontal cross-section view of a fusing unit 10 of a fusing device using a halogen lamp as a heat source. Referring to FIG. 1, the fusing unit 10 includes a fusing roller 11 and a heating element 12 composed of the halogen lamp installed in the center of the heating element 12. A coating layer 11*a* made of Teflon is formed on the surface of the fusing roller 11. The heating element 12 generates heat inside the fusing roller 11, and the fusing roller 11 is heated via the radiant heat emitted from the heating element 12.

FIG. 2 is a block diagram of a conventional fusing device using a halogen lamp as a heat source. Noise signals included in a voltage applied from a predetermined power voltage 210 are filtered via a line filter unit 220, and the filtered input voltage is supplied to a heating unit 250 of a fusing roller 240. The heating unit 250 is resistance heated by the input voltage, and the heat generated at the heating unit 250 heats the fusing roller 240. The temperature of the fusing roller 240 is sensed by a sensing unit 260, and a controlling unit 270 controls the on/off operation of a switch 230 to control the temperature of the fusing roller 240 based on the temperature of the fusing roller 240.

A conventional fusing unit using a halogen lamp as a heat source requires several seconds to several minutes of warm-up time to heat a fusing roller from when power is supplied to the fusing unit until it reaches a target fusing temperature. Therefore, a user has to wait during the long warm-up time.

When using the halogen lamp as the heat source, the current flowing through the heating unit is determined by the applied voltage, and the current which flows to the heating unit drastically increases when the voltage is applied, thereby reducing the flicker characteristics of the fusing device.

SUMMARY OF THE INVENTION

Embodiments of the present invention provide a fusing device with improved flicker characteristics by instantly controlling the size of the induced voltage input to a fusing unit in an image printing apparatus which heats the fusing unit using the induced voltage.

According to an aspect of embodiments of the present invention, a fusing device which fuses and fixes a toner onto a print paper is provided. The fusing device includes a fusing unit which is resistance heated or induction heated by an induced current, and fuses the toner onto the print paper using the generated heat. A sensing unit senses the temperature of the fusing unit. A reference current generating unit generates a predetermined reference current to heat the fusing unit to reach a predetermined temperature based on the temperature of the sensed fusing unit and the reference temperature. A pulse width modulation signal generating unit generates a pulse width modulation signal for generating the induced current so that the induced current corresponding to the reference current is input to the fusing unit.

The fusing unit preferably includes an AC current generating unit which generates an AC current corresponding to the pulse width modulation signal. An insulating unit preferably receives the AC current and generates an induced current corresponding to the AC current. A toner fusing unit is preferably resistance heated and induction heated by receiving the induced current, and fuses the toner onto the print paper by the generated heat.

The reference current generating unit preferably includes a comparator for comparing the difference between the temperature of the fusing unit sensed by the sensing unit and the predetermined reference temperature. A proportional-integral (PI) temperature controller calculates a control gain based on the sensed temperature difference so that the sensed temperature of the fusing unit can be close to the value of the reference temperature. A first signal generator generates a reference current to increase the temperature of the fusing unit to the same temperature as the reference temperature based on the control gain.

The pulse width modulation signal generating unit preferably includes a comparator for comparing the difference between the reference voltage and the induced current actually input to the fusing unit by the pulse width modulation signal. A PI current controller calculates a control gain based on the difference so that the induced current can be close to the value of the reference current. The pulse width modulation signal generating unit preferably generates the pulse width modulation signal to compensate for the difference between the induced current and the reference current based on the control gain.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The above and other features and advantages of exemplary embodiments of the present invention will become more apparent inform the following detailed description in conjunction with the attached drawings in which.

Throughout the drawings, like reference numbers will be understood to refer to like elements, features and structures.

DETAILED DESCRIPTION OF EXEMPLARY EMBODIMENTS

Exemplary embodiments of the present invention will now be described more fully with reference to the accompanying drawings.

Figure 1:
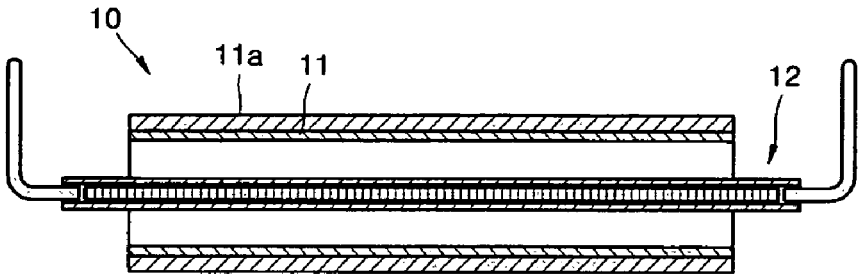
FIG. 1 (Related art)
FIG. 1 is a schematic horizontal cross-section view of a conventional fusing unit of a fusing device using a halogen lamp as a heat source.
Figure 2:
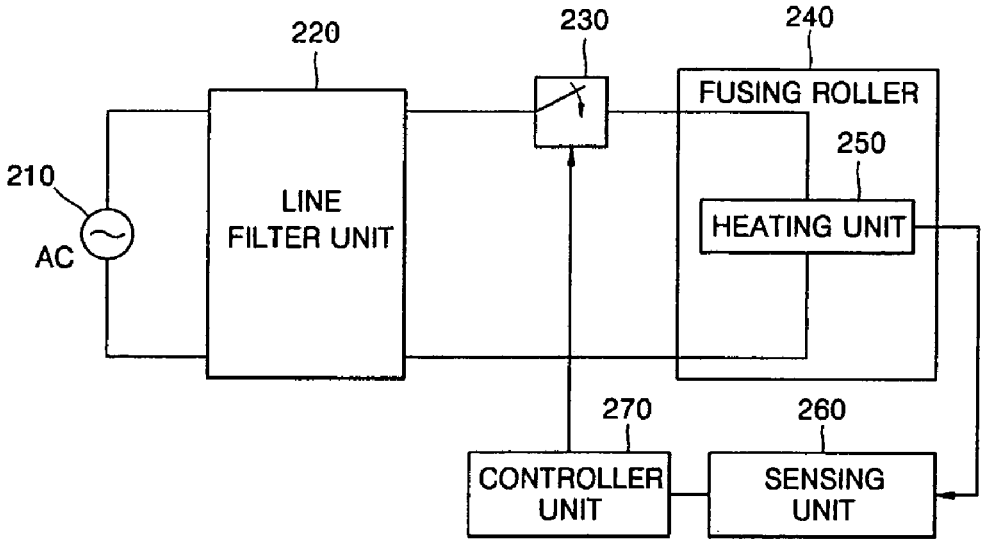
FIG. 2 (Related art)
FIG. 2 is a block diagram of a conventional fusing device using a halogen lamp as a heat source.
Figure 3:
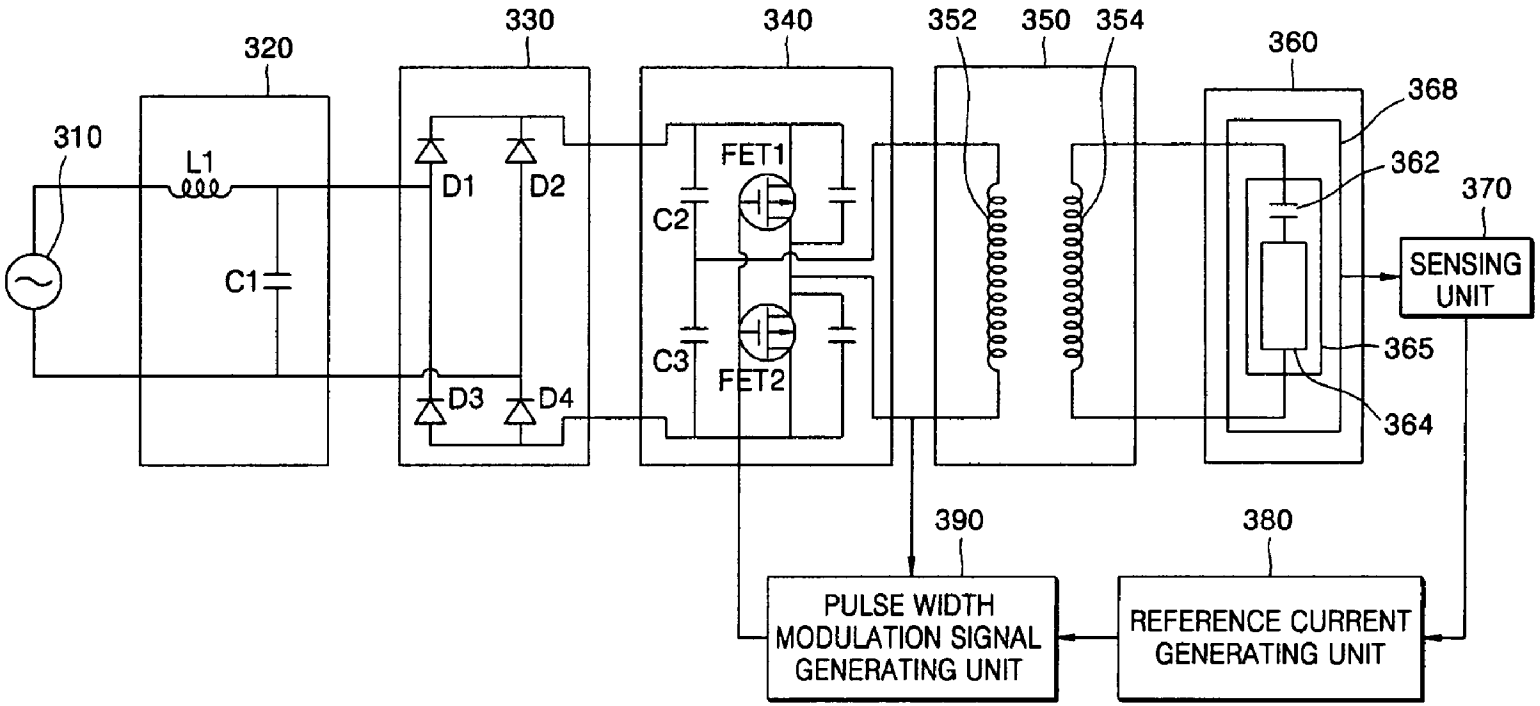
FIG. 3 is a block diagram of a fusing device according to an exemplary embodiment of the present invention.

FIG. 3 is a block diagram of a fusing device according to an embodiment of the present invention. Referring to FIG. 3, the fusing device includes an AC current generating unit 340, an insulating unit 350, a fusing unit 360, a sensing unit 370, a reference current generating unit 380, and a pulse width modulation signal generating unit 390. The fusing device further includes a power unit 310 which supplies current input to the AC current generating unit 340, a line filter unit 320, and a rectifying unit 330.

The power unit 310 provides an AC current of predetermined magnitude and frequency to the line filter unit 320. The line filter unit 320 preferably comprises an inductor L1 and a capacitor C1, and receives the AC current from the power unit 310 and removes high frequency components included in the AC current. The line filter unit 320 is only one example to explain embodiments of the present invention and it should be understood that any suitable type of line filter unit may be used, and such line filter units are included within the scope of the present invention.

The rectifying unit 330 rectifies the AC current output from the line filter 320 into a DC current. The rectifying unit 330 illustrated in FIG. 3 is a bridge rectifier composed of four diodes D1, D2, D3, and D4, and the AC current is rectified into the DC current according to the polarity of the four diodes D1, D2, D3, and D4. Any suitable type of rectifiers can be used to rectify the AC current into DC current, and such rectifiers are included within the scope of the present invention.

The AC current generating unit 340 receives the DC current from the rectifying unit 330 and generates an AC current of a predetermined frequency. The AC current generating unit 340 includes two capacitors C2 and C3 and two field-effect transistors FET1 and FET2. A pulse width modulating signal generated at the pulse width modulation signal generating unit 390 is input to gates of the field-effect transistors FET1 and FET2, and the field-effect transistors FET1 and FET2 operate in turns according to the input pulse width modulation signal, thereby generating high frequency AC current. The AC current generating unit 340 may be configured as a half-bridge inverter, and any suitable type of AC current generating unit may be used depending on the field in which the present invention is applied.

The insulating unit 350 generates an induced current using the AC current generated at the AC current generating unit 340. The induced current generated at the insulating unit 350 is supplied to the fusing unit 360. A transformer is described below, and the transformer may be a high frequency transformer of smaller volume than a low frequency transformer.

When the AC current flows through a first coil 352 of the transformer 350, a magnetic field around a second coil 354 changes, thereby generating an induced current in the second coil 354 due to the changed magnetic field. The induced current generated by the transformer 350 is supplied to a heating unit 365 of the fusing unit 360. The size of the induced current can be controlled by winding ratios of the first and second coils 352 and 354. The current of the power unit 310 flowing through the first coil 352 of the transformer 350 generates the induced current in the second coil 354 of the transformer 350, and the generated induced current is supplied to the fusing unit 360. The power unit 310 and the fusing unit 360 are electrically separated since the second coil 354 is supplied with the induced current generated at the transformer 350 instead of the current of the power unit 310.

The fusing unit 360 includes a fusing roller 368 which fuses and fixes a toner onto a print paper via the heating unit 365, which is resistance heated or induction heated by the induced current generated at the insulating unit 350, and using the beat generated by the heating unit 365. The heating unit 365 includes a heating element 364 which receives the induced current and is induction heated or resistance heated, a thin insulating layer (not shown) to prevent the heating element 364 from being short-circuited with the fusing roller 368, and a resonant capacitor 362. Preferably, the heating unit 364 is a coil, and the coil has a predetermined inductance and resistance. The inductance of the coil and the resonant capacitor 362 comprise a resonant circuit.

The sensing unit 370 senses the temperature of the fusing roller 368, and generates a sensing signal indicating the temperature of the fusing roller 368 and transmits the sensing signal to the reference current generating unit 380.

The reference current generating unit 380 compares the difference between the temperature of the fusing unit 360 and a predetermined target temperature of the fusing unit 360 with reference to the sensing signal, and generates a reference current to increase the temperature of the fusing unit 360 to the reference temperature based on the result of the comparison. The target temperature of the fusing unit 360 denotes a preset temperature of the fusing unit 360 to appropriately fuse and fix the toner onto the print paper. The reference current generating unit 380 according to an embodiment of the present invention will be described in more detail with reference to FIG. 4 below.

The pulse width modulation signal generating unit 390 generates a pulse width modulation signal of a predetermined frequency so that the induced current corresponding to the reference current is input to the fusing unit 360, and transmits the generated pulse width modulation signal to the gates of the field-effect transistors FET1 and FET2. The field-effect transistors FET1 and FET2 are alternately switched according to the pulse width modulation signal and generate an AC current of predetermined frequency, and the induced current is generated at the insulating unit 350 due to the generated AC current. The heating unit 365 comprised of the fusing unit 360 is heated by the induced current generated based on the reference current and thus the temperature of the fusing unit 360 can be controlled by an optimum instant current instead of the maximum induced current.

Figure 4:
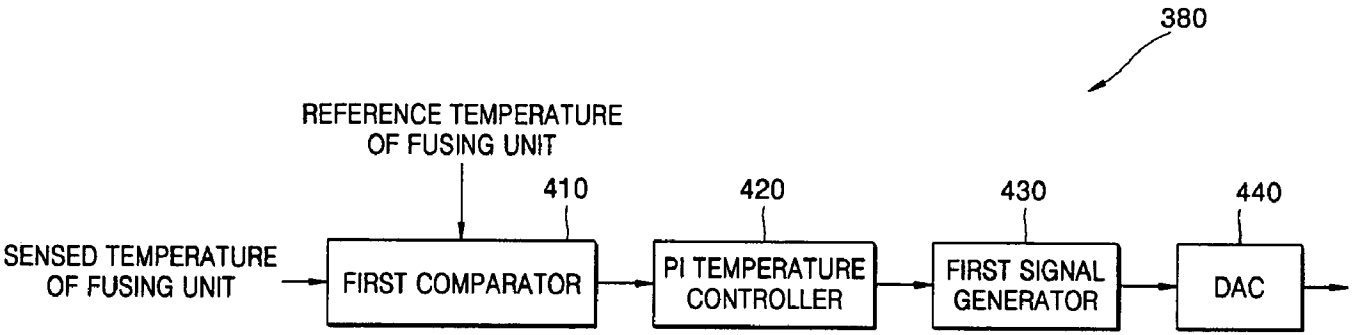
FIG. 4 is a block diagram of a reference current generating unit illustrated in FIG. 3.

FIG. 4 is a block diagram of the reference current generating, unit 380 in FIG. 3. Referring to FIG. 4, the reference current generating unit 380 includes a first comparator 410, a proportional-integral (PI) temperature controller 420, a first signal generator 430, and a digital-to-analog converter (DAC) 440.

The first comparator 410 compares a first difference between the temperature of the fusing unit 360 sensed by the sensing unit 370 and the target temperature of the fusing unit 360. The PI temperature controller 420 calculates a control gain to bring the sensed temperature of the fusing unit 360 near the target temperature of the fusing unit 360 based on first difference calculated by the first comparator 410. The control gain is proportional to the first difference between the temperature of the fusing unit 360 and the target temperature of the fusing unit 360. The first signal generator 430 generates the reference current based on the control gain to maintain the temperature of the fusing unit 360 as the reference temperature. The DAC 440 converts the reference voltage from a digital signal into an analog signal.

Figure 5:
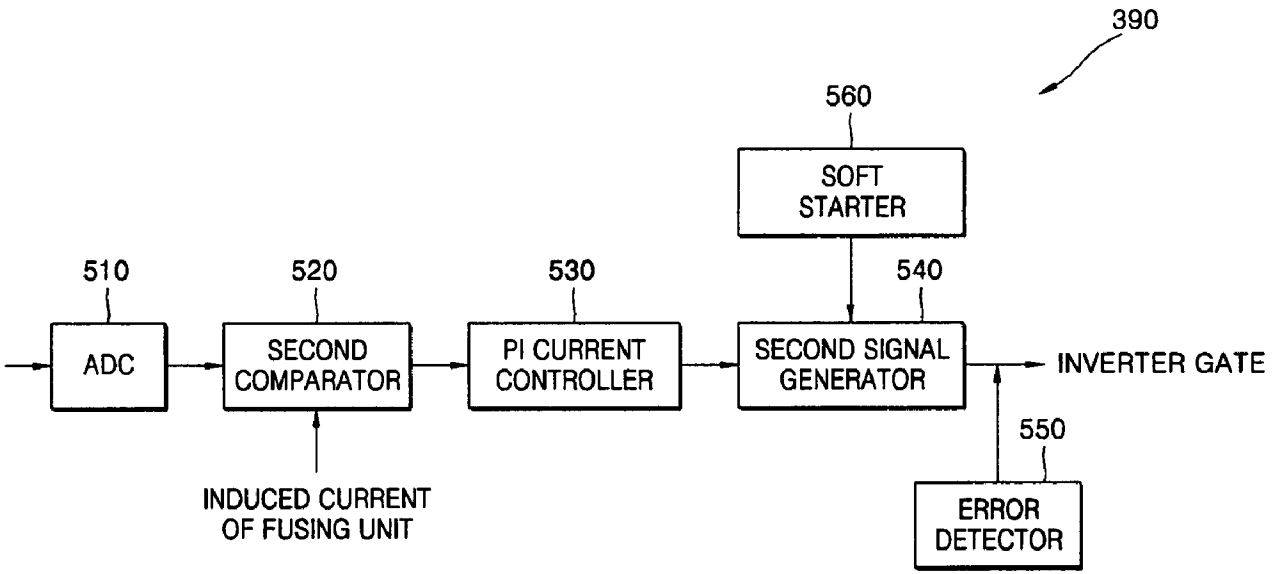
FIG. 5 is a block diagram of a pulse width modulation signal generating unit illustrated in FIG. 3.

FIG. 5 is a block diagram of the pulse width modulation signal generating unit 390 illustrated in FIG. 3. Referring to FIG. 5, the pulse width modulation signal generating unit 390 includes an analog-to-digital converter (ADC) 510, a second comparator 520, a PI current controller 530, a second signal generator 540, an error detector 550, and a soft starter 560.

The ADC 510 converts the analog reference current transmitted from the DAC 440 into a digital signal. The second signal generator 540 generates a pulse width modulation signal with reference to the reference current so that an induced current is generated corresponding to the reference current, and transmits the generated pulse width modulation signal to the field-effect transistors FET1 and FET2 of the AC current generating unit 340.

A low frequency AC current is generated at the AC current generating unit 340 as the frequency of the generated pulse width modulation signal is lower, and as the low frequency AC current is input to the insulating unit 350, high induced current is transmitted to the fusing unit 360. Therefore, the pulse width modulation signal generating unit 390 generates pulse width modulation signals of different frequencies based on the reference current so that the temperature of the fusing unit 360 is maintained at the reference temperature.

Meanwhile, the second comparator 530 calculates a second difference between the induced current actually input to the fusing unit 360 and the reference current. The PI current controller 530 calculates a control gain to control the induced current to reach the reference current based on the second difference calculated by the second comparator 530. The second signal generator 540 controls the frequency of the pulse width modulation signal to compensate for the second difference based on the control gain calculated by the PI current controller 530.

The error detector 550 senses the input current or an input voltage input to the power unit 310, the input current or voltage input to the fusing unit 360, the temperature of the field-effect transistors FET1 and FET2 and as a result can detect errors in the fusing device. When an error is detected, the error detector 550 intercepts the pulse width modulation signal transmitted to the AC current generating unit 340.

The soft starter 560 controls the frequency of the pulse width modulation signal to gradually decrease to prevent the induced current transmitted to the fusing unit 360 from drastically increasing.

Meanwhile, the coil of the fusing unit 360 has a very low inductance, and thus the resonant frequency of the resonant circuit composed of the resonant capacitor 362 and the inductance of the coil has a very high value. The switching frequency of the AC current generating unit 340 should preferably be set twice as high as the resonant frequency.

Referring to FIGS. 4 and 5, the reference current generated at the reference current generating unit 380 is converted into an analog signal at the DAC 440 and transmitted to the pulse width modulation signal generating unit 390, and the ADC 510 of the pulse width modulation signal generating unit 390 converts the analog reference current from an analog signal into a digital signal.

In another embodiment of the present invention, the reference current generating unit 380 includes a pulse width modulation signal generator (not shown) instead of the DAC 440, and the generated reference current is converted into a pulse width value by the pulse width modulation signal generator. Meanwhile, the pulse width modulation signal generating unit 390 includes an averaging element (not shown) instead of the ADC 510, and the averaging element averages the reference current expressed in the pulse width value and obtains an averaged reference current.

In another embodiment of the present invention, the reference current generating unit 380 and the pulse width modulation signal generating unit 390 are connected by a serial port, and the reference current generated at the reference current generating unit 380 is directly transmitted to the pulse width modulation signal generating unit 390 via the serial port. The reference current can be transmitted from the reference current generating unit 380 to the pulse width modulation signal generating unit 390 according to another embodiment of the present invention depending on the particular application of the present invention, and such embodiment is included in the scope of the present invention.

Figure 6A:
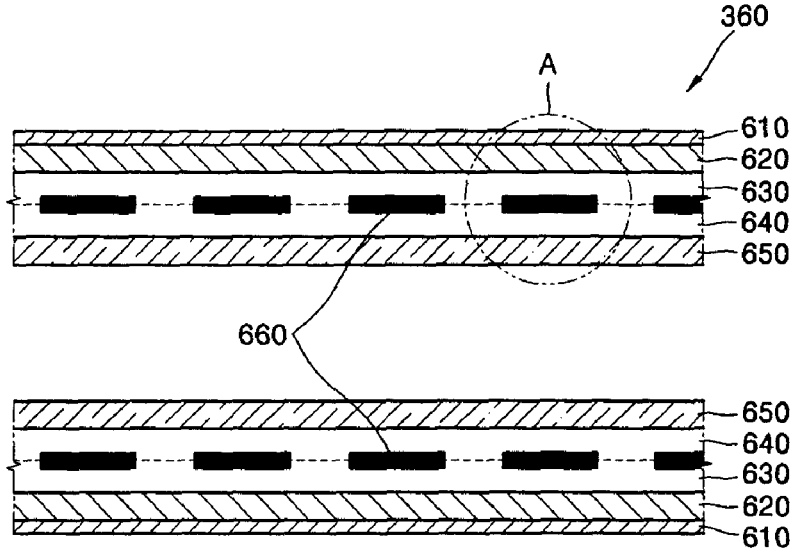
FIGS. 6A and 6B are views of a fusing unit of the fusing device illustrated in FIG. 3 and a heating unit of the fusing unit illustrated in FIG. 6A, respectively.
Figure 6B:
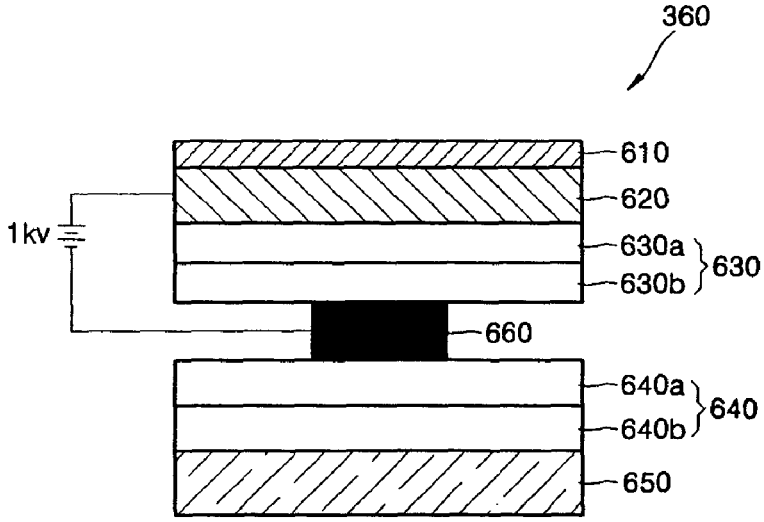

FIG. 6A is a horizontal cross-section of the fusing unit 360 of the fusing device in FIG. 3, and FIG. 6B is a view of the heating unit of the fusing unit 360 in FIG. 6A.

Referring to FIG. 6A, the fusing unit 360 includes a cylindrical fusing roller 620. The surface of the cylindrical fusing roller 620 is coated with a protective layer 610. The protective layer is preferably formed of a non-stick substance such as Teflon. An expanding and adhering unit 650 is preferably installed within the fusing roller 620, both ends of which are preferably exposed. A heating element 660 is interposed between the fusing roller 620 and the expanding and adhering unit 650. The expanding and adhering unit 650 is spirally wound around the heating element 660, which generates heat by receiving current from an external power source. A first insulating layer 630 and a second insulating layer 640 cover the heating element 660 to insulate the heating element 660 so that the fusing roller 620 and the expanding and adhering unit 650 are not short-circuited.

The fusing roller 620 as illustrated in FIG. 6A is an example of the toner fusing unit 360 for fusing the toner from the fusing unit 360, and other types of toner fusing units may be used depending on the particular application of the present invention. Other such toner fusing units are within the scope of the present invention.

The heating element 660 may be a coil. Other types of heating elements may be used depending on the particular application of the present invention, and such heating elements are within the scope of the present invention.

The coil produces resistance heat due to a first induced current generated at the transformer 350. In addition, the first induced current generated at the transformer 350 is an AC current corresponding to the AC current input to the transformer 350. When the first induced current, which is the AC current, is supplied to the coil, an alternating magnetic flux, which alternates according to the first induced current, is generated around the coil. The generated alternating magnetic flux is interlinked to the fusing roller 620, and an induced current (that is, an eddy current) is generated in a direction that interferes with the change of the alternating magnetic flux at the fusing roller 620. The induced current generated in the fusing roller 620 by the interlinked alternating magnetic flux is called a second induced current. The fusing roller 620 may be made of a copper alloy, an aluminum alloy, a nickel alloy, an iron alloy, a chromium alloy, a magnesium alloy, or any other suitable substance, and the fusing roller 620 has a self-inherent resistance, thereby being resistance heated by the second induced current. Hereinafter, the process by which the fusing roller 620 is heated by the second induced current will be referred to as induction heating. The fusing roller 620 may be made of different materials depending on the particular application of the present invention, and such fusing rollers are within the scope of the present invention.

The heating element 660 may be made of a copper alloy, an aluminum alloy, a nickel alloy, an iron alloy, a chromium alloy, a magnesium alloy, or any other suitable substance and preferably produces a resistance across the ends of the heating element 660 of 100Ω or less in order to produce resistance heat by resistance loss of the heating element 660 when current is applied. The heating element 660 may be made of other materials depending on the particular application of the present invention, and such heating elements are within the scope of the present invention.

The first insulating layer 630 is interposed between the fusing roller 620 and the heating element 660, and the second insulating layer 640 is interposed between the heating element 660 and the expanding and adhering unit 650. The first and second insulating layers 630 and 640 may be made of mica, polyimide, ceramic, silicon, polyurethane, glass, polytetrafluoruethylene (PTFE), or any other suitable substance. The first and second insulating layers 630 and 640 may be made of other materials depending on the particular application of the present invention, and such insulating layers are within the scope of the present invention.

FIG. 6B is a detailed view of a section A illustrated in FIG. 6A. The first insulating layer 630 is comprised of two insulating layers 630*a* and 630*b*, and the second insulating layer 640 is comprised of two insulating layers 640*a* and 640*b*. The first insulating layer 630 prevents the heating element 660 from being short-circuited by the fusing roller 620. A thin insulating layer, which prevents only the short-circuiting of the heating element 660, is interposed between the heating element 660 and the fusing roller 620. Preferably, the inner voltage of the first insulating layer 630 is 1 kV or less. To satisfy the 1 kV or less inner voltage condition, the first insulating layer 630 of the fusing unit 360 can be made of a sheet of mica of approximately 0.1 mm thickness to prevent short-circuiting of the heating element 660 and the fusing roller 620. Preferably, two sheets of mica (that is, the two insulating layers 630*a* and 630*b*), each being 0.1 mm thick, can be used to prevent short-circuiting of the heating element 660 and the fusing roller 620 in the event of one of the sheets of mica of 0.1 mm being damaged.

If the thickness of the first insulating layer 630 interposed between the fusing roller unit 620 and the heating element 660 is increased, heat generated at the heating element 660 is not efficiently transmitted to the fusing roller 620. In other words, the heat generated in the heating element 660 can be efficiently transmitted to the fusing roller 620 if the thickness of the first insulating layer 630 is reduced. The first insulating layer 630 may be made of other materials and be of different thickness depending on the particular application of the present invention, and such insulating layers are within the scope of the present invention.

Figure 7:
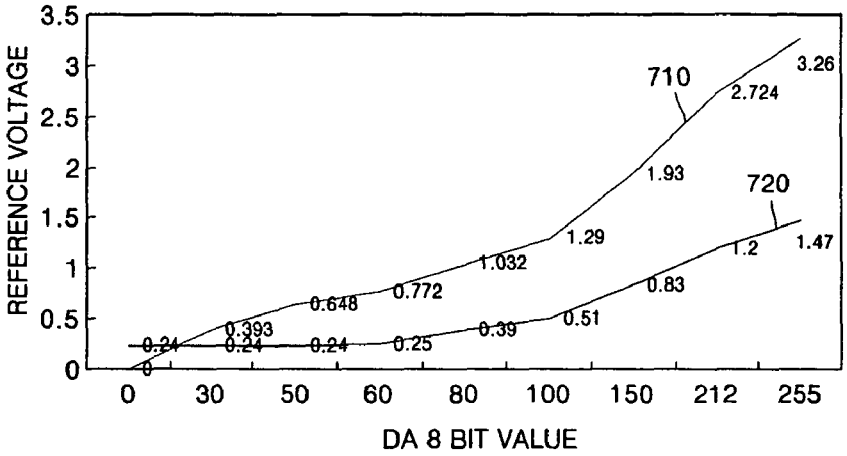
FIG. 7 is a graph illustrating the power output from the fusing unit according to a reference current.

FIG. 7 is a graph illustrating the power output from the fusing unit 360 according to the reference current. The x-axis represents values of the reference current expressed in 8 bit resolution, and the y-axis represents the reference voltage value corresponding to the 8 bit resolution. A line 710 illustrates the changed value in the reference current value, and a line 720 illustrates an output current of the fusing unit 360 corresponding to the changed value in the reference current value. Referring to FIG. 7, it can be seen that the output of the fusing unit 360 rises linearly from 240 W to 1.5 kW in line with the lowest reference current value to the highest reference current value.

Figure 8:
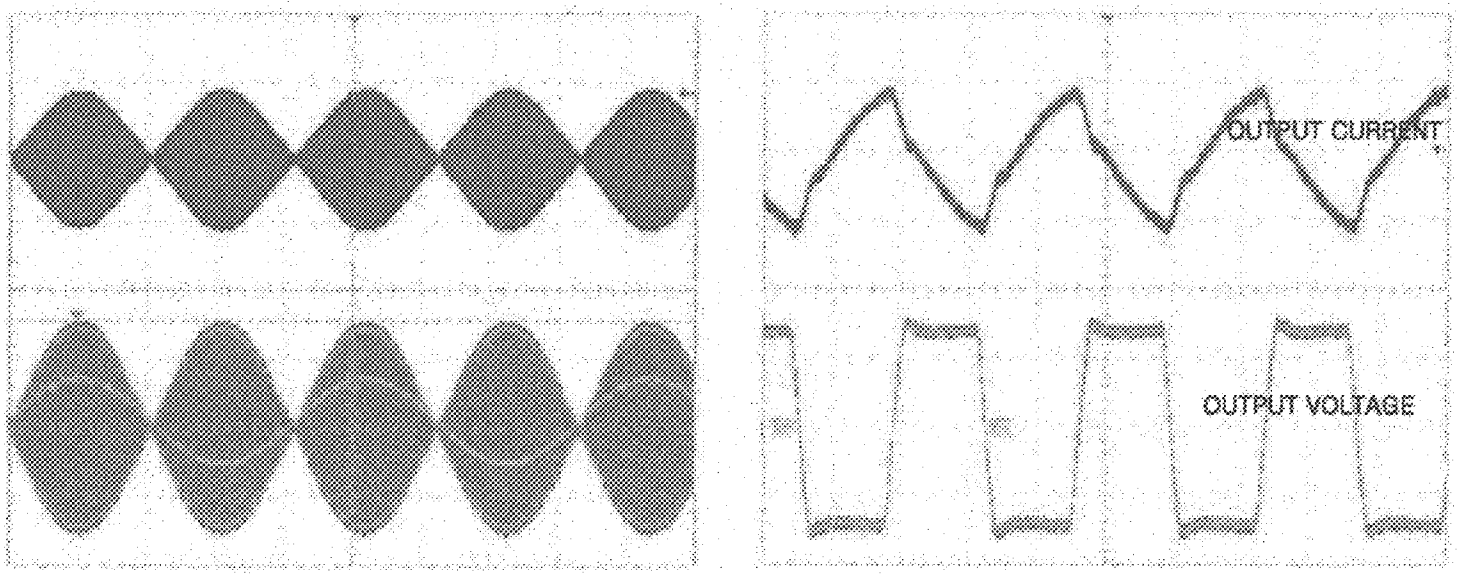
FIG. 8 is a graph illustrating an output current and an output voltage of an AC current generating unit to provide the maximum induced current to the fusing unit according to an embodiment of the present invention.

FIG. 8 is a graph illustrating an output current and an output voltage of the AC, current generating unit 340 to provide the maximum induced current to the fusing unit 360. The pulse width modulation signal transmitted to the AC current generating unit 340 has a low frequency to generate the output current and the output voltage as illustrated in FIG. 8.

Figure 9:
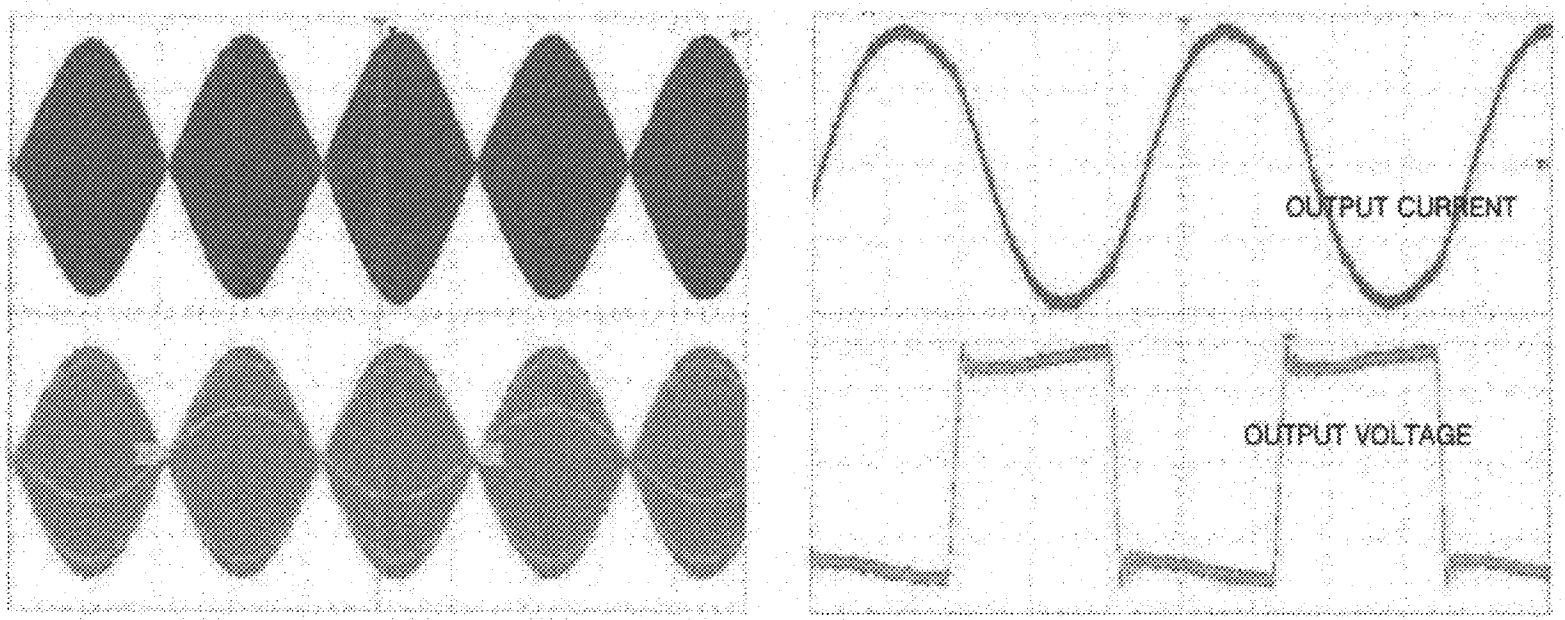
FIG. 9 is a graph illustrating an output current and an output voltage of the AC current generating unit to provide a medium-sized induced current to the fusing unit according to an exemplary embodiment of the present invention.

FIG. 9 is a graph illustrating an output current and an output voltage of the AC current generating unit 340 to provide a medium-sized induced current to the fusing unit 360. The pulse width modulation signal transmitted to the AC current generating unit 340 has a medium frequency to generate the output current and the output voltage as illustrated in FIG. 9.

Figure 10:
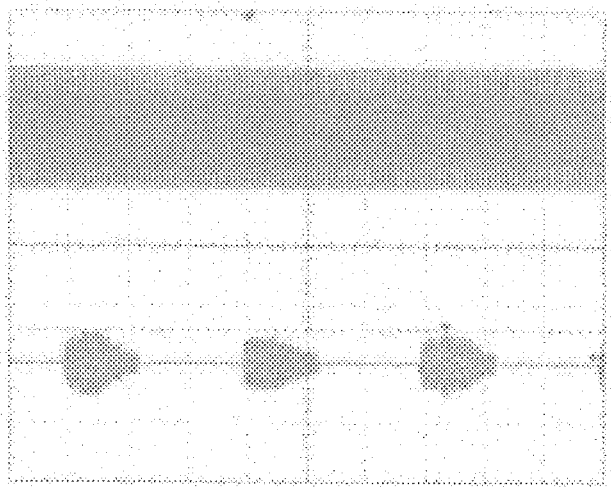
FIG. 10 is a graph illustrating a current and a voltage input to the fusing unit according to an exemplary embodiment of the present invention.

FIG. 10 is a graph of a current and a voltage input to the fusing unit 360. The maximum induced current is not input to the fusing unit 360 and the optimum induced current is input to the fusing unit 360 to maintain the fusing unit 360 at the reference temperature because the fusing device instantly controls the size of the induced current based on the difference between the temperature of the fusing unit 360 and the reference temperature.

As described above, in a fusing device, the heat generated in a coil is efficiently transmitted to a fusing roller by a thin insulating layer in the fusing device, and thus the fusing roller can be quickly heated to reach a target temperature at room temperature. In addition, the induced current input to the fusing roller can be instantly controlled based on the difference between the temperature of the fusing unit and the reference temperature of the fusing roller, thereby transmitting the optimum induced current to the fusing roller and improving the flicker.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A fusing device which fuses and fixes a toner onto a print paper, comprising:

an AC current generating unit which generates an AC current having a frequency corresponding to a pulse width modulation signal;

an insulation unit which receives the AC current and generates a magnetically induced current corresponding to the AC current;

a fusing unit which is resistance heated or induction heated by the induced current, and fuses the toner onto the print paper using the generated heat;

a sensing unit which senses the temperature of the fusing unit;

a reference current generating unit which compares the temperature of the fusing unit sensed by the sensing unit with a predetermined reference temperature; and generates a predetermined reference current for controlling the temperature of the fusing unit based on the result of the comparison between the temperatures; and a pulse width modulation signal generating unit which compares the reference current with the induced current input to the fusing unit; generates the pulse width modulation signal for compensating for a difference between the induced current and the reference current based on the result of comparison of the currents; and outputs the pulse width modulation signal to the AC current generating unit.

2. The fusing device of claim 1, wherein the fusing unit comprises:

a toner fusing unit which is resistance heated and induction heated by receiving the induced current, and fuses the toner onto the print paper by the generated heat.

3. The fusing device of claim 2, wherein the reference current generating unit comprises:

a comparator for comparing the difference between the temperature of the fusing unit sensed by the sensing unit and the predetermined reference temperature;

a proportional-integral (PI) temperature controller for calculating a control gain based on the sensed temperature difference so that the sensed temperature of the fusing unit can be close to the value of the reference temperature; and a first signal generator for generating a reference current to increase the temperature of the fusing unit to the same temperature as the reference temperature based on the control gain.

4. The fusing device of claim 3, wherein the pulse width modulation signal generating unit comprises:

a comparator for comparing the difference between the reference voltage and the induced current actually input to the fusing unit by the pulse width modulation signal; and a PI current controller for calculating a control gain based on the difference so that the induced current can be close to the value of the reference current, wherein the pulse width modulation signal generating unit generates the pulse width modulation signal to compensate for the difference between the induced current and the reference current based on the control gain.

5. The fusing device of claim 4, wherein the pulse width modulation signal generating unit further comprises a soft starter for controlling the frequency of the pulse width modulation signal so that the value of the induced current gradually increases to the value of reference current during a predetermined amount of time.

6. The fusing device of claim 4, wherein the reference current generating unit further comprises a first converter which is a digital-to-analog converter (DAC), for converting the generated reference current to an analog signal; and the pulse width modulation signal generating unit further comprises a second converter which is an analog-to-digital converter (ADC), for receiving the analog reference current and converting the analog reference current into a digital signal.

7. The fusing device of claim 4, wherein the reference current generating unit further comprises a converter for converting the generated reference current into pulse width values, and the pulse width modulation signal generating unit further comprises an averaging unit for averaging the pulse width values and calculating the reference current.

8. The fusing device of claim 4, wherein the AC current generating unit is a half-bridge inverter.

9. The fusing device of claim 8, wherein the insulating unit is a transformer which electrically insulates the half-bridge inverter and the fusing unit.

10. The fusing device of claim 9, wherein the fusing unit comprises:

a heating unit which is resistance heated or induction heated by the induced current; and a fusing roller which fuses the toner onto the print paper using the heat generated by the heating unit, wherein the heating unit comprises:

a heating element which has a predetermined inductance and resistance;

a resonant capacitor which forms a resonance together with the inductance of the heating element; and an insulating layer for insulating the heating element and the fusing roller.

11. The fusing device of claim 10, wherein the inner voltage of the insulating layer is 1 kV.

12. The fusing device of claim 10, wherein the heating element and the fusing roller are closely adhered to each other and rotate together.

13. The fusing device of claim 1, wherein the pulse width modulation signal generating unit compares the reference current with the induced current input to the fusing unit, generates the pulse width modulation signal whose frequency varies based on the result of the comparison of the currents, and outputs the pulse width modulation signal to the AC current generating unit.

14. The fusing device of claim 13, wherein the pulse width modulation signal input to the AC current generating unit is a rectangular wave having a duty cycle of 50%, whose frequency varies based on the result of the comparison of the currents.

* * * * *